United States Patent [19]

Ross

[11] 4,068,548

[45] Jan. 17, 1978

[54] METHOD AND A TOOL FOR CUTTING MATERIALS

[76] Inventor: Cray L. Ross, 309 Jackson Road, Enfield, Conn. 06082

[21] Appl. No.: 682,910

[22] Filed: May 4, 1976

Related U.S. Application Data

[60] Division of Ser. No. 503,182, Sept. 4, 1974, abandoned, which is a continuation of Ser. No. 355,170, April 27, 1973, abandoned.

[51] Int. Cl.[2] ..... B26F 3/12

[52] U.S. Cl. ..... 83/1; 83/171; 83/651.1

[58] Field of Search ..... 83/1, 5, 171, 651.1, 83/554, 555, 16

[56] References Cited

U.S. PATENT DOCUMENTS 3,610,078 10/1971 Rowlands ..... 83/1

*Primary Examiner*—J. M. Meister

*Attorney, Agent, or Firm*—Frederick W. Turnbull

[57] ABSTRACT

A method of cutting desired pieces from a heat-severable material in which a tool is provided to cut a shape corresponding to one projection of the pieces in one direction and to cut a second projection of the desired pieces in a direction at right angles to said first cut, and a unitary tool to perform the method.

6 Claims, 8 Drawing Figures

FIG. 1
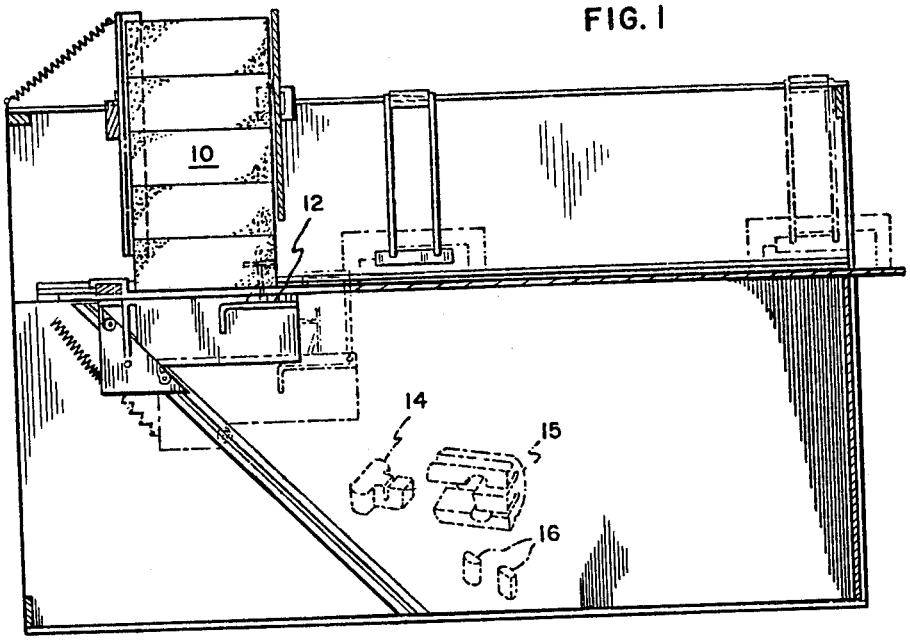
FIG. 2
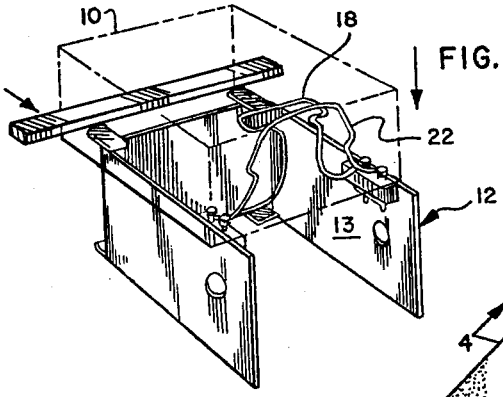
FIG. 3
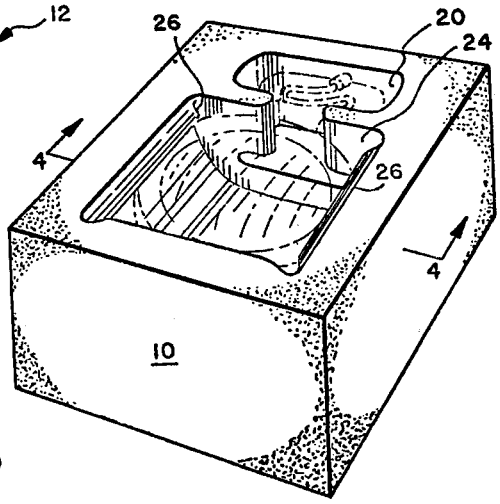
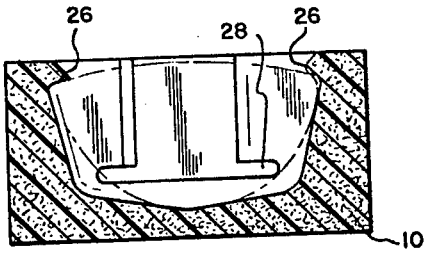
FIG. 4

METHOD AND A TOOL FOR CUTTING MATERIALS

This application is a division of applicant's application Ser. No. 503,182, filed Sept. 4, 1974, now abandoned, which is a continuation of applicant's application Ser. No. 355,170 filed Apr. 27, 1973, now abandoned.

In attempting to use the method and machine disclosed in Patent Application Ser. No. 191,383, filed Oct. 21, 1971, it became clear that there were shapes that it would be desirable to cut from the packing material, such as polystyrene foam blocks that could not be cut using the disclosed method and the disclosed tools for use in the machine of that application.

Materials, such as polystyrene blocks are inexpensive, but shapes other than rectilinear have been very expensive because of the need to form molds into which the material is expanded to make the non-rectilinear shapes.

By use of the method of the present invention many irregular shapes may be cut from blocks of material by use of a tool far less complicated than the tool disclosed in the earlier application.

It is an object of the present invention to provide a method of cutting irregular shapes from rectilinear blocks of packing material and to cut blind cavities including under-cut portions to receive and hold merchandise for shipping.

It is a further object of the present invention to provide a method and a tool for cutting a plurality of similar cavities to receive a plurality of identical objects in a single block of material in a single step operation of the machine.

It is still a further object of the present invention to provide a tool or types of tools for use in practicing the method.

Other and further objects and advantages will appear from the following specification taken with the accompanying drawings in which like reference numerals refer to similar parts in the several views and in which:

FIG. 1 is a section of a machine using a tool of the present invention to practice the method;

FIG. 2 is a perspective view of the tool in use in FIG. 1;

FIG. 3 is a perspective view of a block of material after a cavity has been cut therein by use of the machine as seen in FIG. 1. An article of merchandise is shown in phantom locked in the cavity;

FIG. 4 is a section on line 4—4 of FIG. 3;

Figure 5:
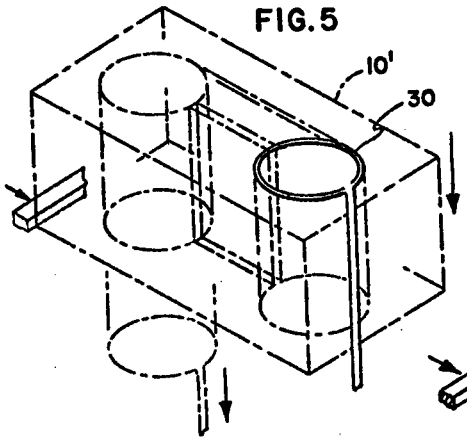
FIG. 5 shows a single wire of a tool for cutting a plurality of cylindrical recesses in a block of material.

Referring to FIG. 1, a plurality of blocks 10 are placed in a hopper above a tool 12, which is seen in detail in FIG. 2. A block 10 moves vertically downward onto tool 12. The block is then pushed to the right in FIG. 1, and in FIG. 2 the distance to cut the entire cavity. The shape of the cavity is shown in FIGS. 3 and 4. The actual shapes of the waste pieces is illustrated at 14, 15 and 16 in FIG. 1.

The tool to make this cavity is shown in FIG. 2, where there are only two hot wire cutting elements provided: a first wire 18 shaped to cut the round ended portion 20 of the finished cavity seen in FIG. 3; and a second wire 22 to cut the larger portion 24 of the cavity. It will be noted that the cavity portion 24 is provided with inwardly projecting ribs 26 so that the major part of this portion of the cavity is "undercut" so that an article to be shipped 28, shown in phantom in FIGS. 3 and 4 will be locked into the cavity with ridges 26 slightly overlying the article.

It will be noticed that the entire portion 20 of the cavity seen in FIG. 3 is cut upon removal of the tool from the block of material. The undercut portion 24 of the cavity is cut by hot wire cutting element 22 that is shaped to define the section seen in FIG. 4, which might be also defined as a projection of the desired cross-section of the waste material. The depth of the undercut, if the waste is to fall out in a single piece 15 is, of course, limited but, since the accuracy of the cut is high, it will give adequate undercut to securely hold the enclosed merchandise.

The wire cutter 18 cuts into the block of material to cut into what will subsequently be waste piece 15 and will then move in the block parallel to the motion of the block, the vertical portion of wire 18 severing waste pieces 16 as it moves forward within the block through a kerf 28 between portions 20 and 24 of the cavity.

While wire 18 is cutting as above, wire 22, lying approximately in the plane of the vertical portions of wire 18, cuts vertically into the block of material. The portions of wire 22 that will undercut ribs 26 will not form an undercut as it moves vertically, but, as it moves horizontally within the block it cuts the undercut shape seen in section in FIG. 4.

When hot wire 22 reaches the end of its travel, and wire 18 has simultaneously reached the end of its travel in the direction of motion of the block, the tool 12 will move with the block in the horizontal direction but will also move downwardly so that wires 18 and 22 cut vertically downwardly in FIG. 1, which would be vertically upwardly in FIG. 3, the horizontal portion of wire 18 forming an open loop cuts the vertical walls of portion 20 of the cavity while wire 22 merely cuts vertically to sever the waste piece 15 from the block.

It will be noted that there is a notch in waste piece 14. This is formed because wire 18 emerges from the block before wire 22 does and the waste piece 14 falls from the block prior to wire 22 completing the cut.

Cutting the cavity shown in FIG. 3 was not possible under the disclosed method of the earlier application, nor was it possible to cut two cavities with a single hot wire cutter in a single pass through the method steps.

In FIG. 5 a wire 30, which may be one of a plurality of identical wires supported on the frame 13 of tool 12 of FIG. 2 (in lieu of wires 18 and 22) is shaped in a loop supported by a vertical portion of the wire. A block of material 10' shown in phantom in FIG. 5, has moved down over the wire loop 30 to cut a cylindrical cavity in the block. This cavity, however, still contains the waste center until the block is pushed to the right as indicated by the arrow at the left hand end of block 10'. The loop of wire 30 severs the waste center of the cylindrical cavity from the block and moves, within the block to a position where the second cylindrical cavity is to be formed.

It will be noted that here, as with wire 18 above, the waste is severed from the bottom of the second cavity before the cylindrical walls of the cavity are cut. As the block continues to move to the right the tool moving now with the block, the wire loop 30 moves vertically out of the block of material to a position similar to that shown in dotted lines in FIG. 5.

It is proposed to provide a plurality of such cutting wire loops 30 spaced in the direction of the length of the block twice as far apart as the desired cavities so that each loop 30 may cut two cavities in the longitudinal direction of motion of the block in the machine. Several rows of such loops may, of course, be provided across the tool.

Figure 6:
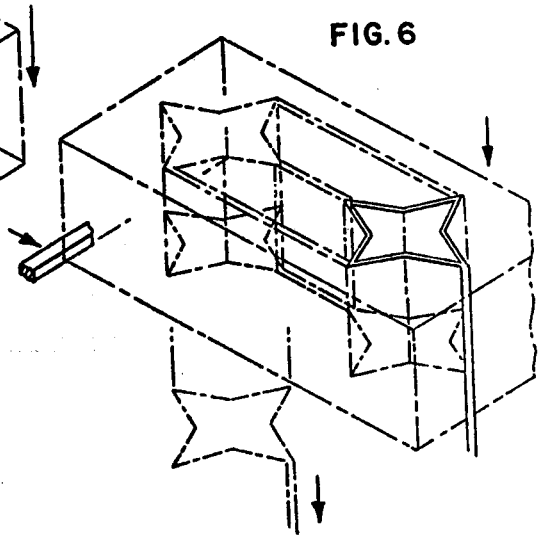
FIG. 6 shows a single wire of a tool for cutting a plurality of star shaped (or irregular) receses in a block of material.

FIG. 6 shows a variant of FIG. 5 in that the loop of wire is of a different shape. Clearly any desired shaped could be selected, and the loop, as shown below in FIG. 8 may be formed in a plurality of sections. The use of this tool is just like that for FIG. 5. Parallel rows of such tools may be located so that the cavities are not in line across the tool, so the cavities would be staggered to permit closer spacing of the cavities.

Figure 8:
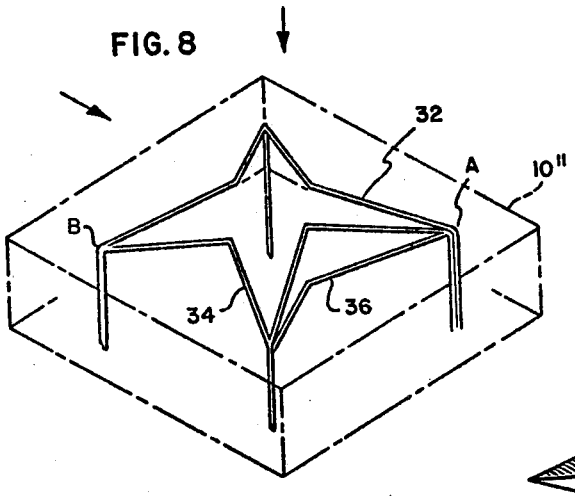
FIG. 8 shows the wires of a tool to cut a single such shape from a block of material.
Figure 7:
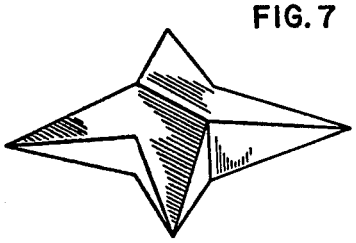
FIG. 7 shows a solid shape to be cut from a block of material.

FIG. 7 shows a solid article cut from the material by the tool illustrated in FIG. 8.

The method here is to cut one projection of the solid article seen in FIG. 7 in one direction, and the other projection of the solid in a direction at right angles to the first cut. This is done by use of a hot wire cutting tool such as seen in FIG. 8.

Since the length of wire needed to cuy the rather large star may need support against bending, and it is desired that the lengths of wire be fairly nearly equal, the star shape is shown as being cut by two wires 32 and 34, each having an electrical connection at points A and B of the star. As shown, these two wires are bent in the generally horizontal plane so that they conform to the gable-shaped upper surface of the star as shown in FIG. 7. The movement of the block 10'' downwardly as shown by the vertical arrow in FIG. 8 cuts the star shaped vertical projection of the desired piece. The horizontal movement of wires 32 and 34 as the block of material 10'' is moved under the influence of the horizontal arrow in FIG. 8 will define the upper gable-shaped surface of the desired article. There is also, however, a hot wire 36 shaped to define the lower surface of the desired article. This wire 36 defines the horizontal projection of the lower surface of the article to be cut. It is to be noticed here that the connections and supports for the several wires must be placed not to cut into the desired article.

As an instance, if the wire loop shown in FIG. 6 were to be used in a manner similar to wires 32 and 34 in FIG. 8, it would be necessary to have the vertical leads be at one of the other corners of the star since, as shown in FIG. 6, the waste of the first vertical cut is cut in half when the block is moved to the position for the second vertical cut.

It will be clear, also, that if the wires 32, 34 defining the star shaped projection of the article shown in FIG. 7 lie in a plane, the wire 36 could be formed into a lozenge-shaped loop defining the horizontal projection of the article of FIG. 7. It would, moreover, be practicable to provide wire 36 in a manner to present two closed lozenge-shaped openings so that two elements shaped as shown in FIG. 7 would be produced simultaneously.

Having thus described the present invention, it will be understood that varing changes may be made which, however, will lie within the scope of the following claims and be protected thereby.

I claim:

1. A method of forming cavities in a block of packing material including the steps of providing at least one heated wire tool, a portion of which heated wire tool is formed as a closed generally planar loop portion defining a figure having an outline corresponding to the section of the cavity to be formed, and a portion formed as a support for said generally planar loop portion, pressing said planar loop portion into a block of packing material in the direction generally normal to the plane of said generally planar loop portion to the depth desired for said cavity to define the side walls of a first cavity, leaving waste material therein, moving said tool in a direction generally parallel to the plane of said generally planar loop portion a distance equal to the distance desired between said plurality of cavities to sever the waste material in said first cavity and to form the bottom surface of a second cavity, and withdrawing said tool from said block of packing material in a direction generally normal to the plane of said generally planar loop portion to form the side walls of the second cavity as the heated wire simultaneously severs the waste material within said second cavity from said block of heat severable material.

2. The method of claim 1 in which the tool is provided with a plurality of said heated wire loap elements, said tool elements being spaced in one direction in lines a distance apart twice the spacing of the adjacent cavities to be made by the tool, and in the other direction spaced the distance desired between adjacent cavaties.

3. A method of forming in a block of material a cavity having two interconnected portions, a first portion being of less lateral and longitudinal extent than a second portion said method comprising the steps of providing a hot wire loop cutting tool lying in a generally horizontal plane and shaped to define the vertical projection of said first portion of the desired cavity, and a second hot wire cutting tool formed in a plane normal to the plane of said loop and shaped to define the horizontal projection of the said second portion of said cavity, inserting said tool into a block of material in a direction normal to the plane of said hot wire loop, then moving said tool in a direction parallel to the plane of said loop a distance corresponding to the length of said second portion of said cavity, then withdrawing said tool in the direction parallel to the direction of its insertion to form the side walls of said first portion of said cavity and to sever the waste material from the interior of said second portion of said cavity.

4. A method of cutting a solid configuration from a block of hot-wire-severable material comprising the steps of providing a hot wire tool having a hot wire arranged in a closed loop to define a first projection of the solid configuration to be cut, and a second hot wire arranged to define a second projection of the solid configuration to be cut at right angles to said first projection, inserting said hot wire tool into said block of material in the direction to cut the material and define the first projection of said configuration, then moving said tool within said material in the direction to cut the material and define the said second projection of the solid configuration to be cut.

5. A method of cutting heat severable material comprising the steps of providing a tool including a support, at least one wire extending from said support connected at each end to an electrical circuit to heat said wire, said wire including support portions extending from said support and a loop portion lying in a plane generally normal to said support portions, inserting said tool into a block of heat severable material in a direction generally normal to said loop portion to the depth defined by said support portions, moving said tool in a direction parallel to the plane of said loop portion a distance greater than the dimension of said loop portion in the direction of movement of said loop portion and withdrawing said tool in the direction generally normal to the plane of said loop portion.

6. The method of claim 5 in which the tool provided includes also a second wire extending from said support and connected at its ends to an electric circuit to heat said wire, said second wire lying generally in a plane normal to the plane of said loop portion and shaped to define the section of the cut being made normal to the direction of movement of said tool through said material.

* * * * *